United States Patent [19]

Raines et al.

[11] Patent Number: 4,744,748

[45] Date of Patent: May 17, 1988

[54] MULTIPLE BURNER TORCH TIP

[75] Inventors: Clifford D. Raines, San Antonio, Tex.; Claudio P. Negro, Lynn, Mass.

[73] Assignee: Wingaersheek Division of Victor Equipment Company, Danvers, Mass.

[21] Appl. No.: 914,636

[22] Filed: Oct. 2, 1986

[51] Int. Cl.[4] ..... F23D 15/02

[52] U.S. Cl. ..... 431/353; 431/344; 431/354; 239/552

[58] Field of Search ..... 431/158, 344, 343, 350, 431/353, 354, 173, 185; 239/399, 400, 402, 552, 556

[56] References Cited

U.S. PATENT DOCUMENTS

| | | | |
|---|---|---|---|
| 979,335 | 12/1910 | Reid . | |
| 1,024,443 | 4/1912 | Gault | 431/353 |
| 1,295,345 | 2/1919 | Monroe | 431/344 |
| 1,818,783 | 8/1931 | Beam | 431/353 |
| 2,252,320 | 8/1941 | Hughey | 239/552 X |
| 2,438,170 | 3/1948 | Hughey | 239/552 X |
| 2,533,143 | 12/1950 | Scharbau et al. | 239/552 X |
| 2,673,602 | 3/1954 | Scorah | 239/447 |
| 2,683,484 | 7/1954 | Falligant | 431/143 |
| 2,712,819 | 7/1955 | Rosen | 126/229 |
| 3,198,239 | 8/1965 | Webster . | |
| 3,558,253 | 1/1971 | Smith et al. | 431/353 |
| 3,559,974 | 2/1971 | Berry | 239/548 X |
| 3,736,093 | 5/1973 | Bowman et al. | 431/344 X |
| 4,013,395 | 3/1977 | Wormser | 431/9 |
| 4,179,262 | 12/1979 | Wardt et al. | 431/354 |
| 4,236,060 | 11/1980 | Butz | 219/125.1 |

FOREIGN PATENT DOCUMENTS

| | | | |
|---|---|---|---|
| 512544 | 10/1930 | Fed. Rep. of Germany | 239/552 |
| 679682 | 4/1930 | France | 431/353 |
| 2239161 | 2/1975 | France | 239/552 |

*Primary Examiner*—Margaret A. Focarino

*Attorney, Agent, or Firm*—Majestic, Gallagher, Parsons & Siebert

[57] ABSTRACT

A torch tip for burning an oxidizer/fuel combustible mixture includes a head having multiple burners so as to produce a plurality of flames. The torch tip includes a venturi acting as a jet pump using fuel metered through an orifice to draw an oxidizer in the form of air entering from cross passages into the venturi and then into a mixing chamber in the torch tip. The combustible mixture then exits into the burners through flameholders which impart a swirling motion to the combustible mixture so that more complete combustion and a higher temperature is achieved. Each flameholder also includes a bluff body portion thereon for causing eddying of the combustible mixture in the burners, thereby further enhancing flameholding and completeness of combustion.

20 Claims, 2 Drawing Sheets

MULTIPLE BURNER TORCH TIP

BACKGROUND OF THE INVENTION

1. Field of the Invention

This invention relates to a torch tip for burning a fuel with an oxidizer. The invention is particularly directed to a multiple burner torch tip for mixing fuel with air and burning the resultant combustible mixture in a plurality of burners located in a burner head at the end of the torch tip.

2. Description of the Prior Art

This invention is an improvement over assignee's U.S. Pat. No. 4,013,395 to Wormser entitled "Aerodynamic Fuel Combuster." In the prior art patent to Wormser, an improvement in torch tips was provided. The Wormser invention provided a dramatic improvement in performance for oxidizer/fuel torches. The prior art Wormser invention includes a flameholder in the form of a vortex generator having one or more flow channels to provide swirling gases to a combustion chamber. The flow channels are constructed so as to impart a swirling motion to the burning gases, which are centrifuged to the outside walls of the combustion chamber, thereby cooling the chamber walls. The flameholders include bluff body means for causing eddying turbulent flow which enhances combustion.

The combined swirl and bluff body effect produced by the flameholder is twofold. First, it provides flameholding with less pressure drop than for only swirl or only bluff body flameholding. Second, it permits higher gas velocity within pressure drop limits imposed by the air injector. This higher gas velocity provides: (1) enough combustion air for a stoichiometric mixture which provides the highest flame temperature and also permits complete combustion within the combustion chamber without need for outside air, and (2) better heat transfer from flame to work because of the higher velocity with which flame impacts the workpiece.

This stoichiometric mixture is not only more efficient because the fuel is completely burned, but also because it resists blowout. Prior conventional torches use an air/fuel mixture which is fuel rich. This reduces the velocity of the gas through the torch so as to prevent blowout. To ensure complete combustion, these prior art torches utilize a secondary combustion with ambient air at a location downstream of the burner. Such secondary combustion is undesirable because it reduces flame temperature as the ambient air cools the flame. The result is that the heating effectiveness of such prior art torches is substantially reduced. The Wormser torch resulted in achieving higher flame temperatures than with prior art secondary combustion torches.

SUMMARY OF THE INVENTION

The instant invention is an improvement over the Wormser prior art device in that it provides a multiple rather than a single burner. Each burner including a flameholder and cylindrical combustion chamber, produces a plurality of flames within each burner which is spaced from each other plurality of flames at the point of exit from the burner head located at the end of the torch tip. This produces significant advantages over even the Wormser single burner torch tip.

A primary object of the invention is to reduce burner noise. In the course of developing high-performance vortex burners of different sizes, it had been observed that small burners are much quieter than larger burners of the same design, and it was discovered that a group of several small burners was much quieter than a single large burner for the same heat output. These discoveries lead to the present invention, conceived as a closely spaced group of small burners within a single burner tip.

In seeking an explanation of the low noise level resulting from burners utilizing this design, it was learned that there is a theoretical basis for the phenomena observed as follows.

Noise in small burners such as propane and acetylene welding and soldering torches is the result of turbulence generated at the flameholder. This turbulence-generated noise is amplified by the flame within the torch combustion space or chamber, and can be extremely loud if it contains frequencies that match a resonant frequency within the combustion chamber. Large, high-performance torches are usually very noisy because high heat-transfer performance requires high gas velocity, and high heat output requires relatively large burner diameter. These two factors combine to produce high turbulence and correspondingly high noise levels.

Turbulence level is indicated by Reynold's Number, a dimensionless relation as follows:

$$R_N = \frac{V\,d\,Rho}{mu}$$

where

V=velocity d=diameter

Rho=gas density and mu=gas viscosity

From this equation it is evident that Reynold's Number, or turbulence level, is proportional to gas velocity and to diameter of the combustion chamber (or any other critical dimension). It can be seen that use of multiple combustion spaces of small diameter will result in lower Reynold's Number and, thus, lower turbulence, than use of a single large combustion space.

A solution to the noise problem that maintains high gas velocity, high heat output, and high performance, has been conceived based on combining several small, quiet burners within a single burner tip. The small burner diameter results in a low Reynold's Number, which indicates a low turbulence level at high gas velocity, and high heat output results from the use of multiple burners. The resulting torch design results in surprisingly low noise level for a large-capacity, high-velocity torch.

Another real advantage and object is better heat distribution. A plurality of burners allows a wider distribution of flame and a better distribution of heat than available with the single point of contact with the single burner. The instant invention results in more even temperature distribution over a workpiece that is heated, because of the multiple points of flame contact. This also produces increased wraparound, where objects such as cylindrical pipes are to be heated. That is, the flame is somewhat able to encircle the cylindrical object and heat the side away from the torch. Better fuel economy also results because the multiple burner tip produces a stable flame, even at lower gas pressures and flow rates than that found with single burner torches.

Briefly, the multiple burner torch tip of the instant invention comprises an elongated, tubular torch tip which is angled to facilitate use. A head is located at the outlet end of the tip, which head contains a plurality of burners in equally spaced symmetrical relation around the central axis of the tip and head. These burners each comprise a flameholder within the head leading to a respective combustion chamber. Each combustion chamber opens to a respective burner outlet on the face of the torch head.

The flameholders each have at least one passage therein oriented at an angle to the direction of gas flow for causing the combustible mixture of oxidizer and fuel from a mixing chamber upstream thereof to have a swirling motion imparted thereto. A centrifugal action causes the heavier unburned gas to be directed to the inner walls of the combustion chamber, thus cooling and preventing damage to the torch head. A bluff body is present on the downstream end of each flameholder, which causes an eddying of the gas mixture behind the flameholder and within the combustion chamber to enhance flameholding and to ensure complete combustion. A transition chamber is present between the mixing chamber and the flameholders to facilitate distribution of the combustible gas evenly to each chamber.

Upstream of the mixing chamber is a venturi which is fed by fuel from an inlet by way of an orifice, as well as cross passages open to the ambient surrounds for admission of air. The venturi operates as a jet pump to deliver a mixture of fuel and oxidizer, in this case air, to the mixing chamber. The design of the ejector pump is otherwise conventional.

In operation, the torch tip having its base with an inlet opening therein is inserted into a conventional torch handle. The handle has included therein a valve for selectively admitting fuel such as propane from a source. Fuel flows through the base and then is metered through the orifice into the intersection of the cross passages where it combines with air. The jet pump effect utilizes fuel momentum to move air through the venturi and into the mixing chamber where it is thoroughly mixed prior to entering the transition chamber. In the transition chamber, the gas mixture is distributed to the plurality of flameholders. As it passes through the plurality of flameholders, the combustible mixture is swirled by angled passages within the flameholders. The torch may be lit by conventional means such as a spark igniter. A distinct plurality of flames then emanates from each burner. Where propane is used, luminous blue streams of combustible gases may be seen to swirl around within each combustion chamber, and a plurality of flames emanates from each combustion chamber outlet.

The number and spacing of the burners may be varied as desired. While the instant discussion focuses on three or four burners equally spaced on a circle, any plurality of two or more can be selected. In addition, various patterns may be selected other than the single circle pattern discussed. For example, the burners may be placed on two or more concentric circles with a single burner in the center. They could alternatively be placed in a rectangular array of rows and columns.

The geometry of the flameholders may vary so long as the desired result of achieving swirling of the incoming combustible mixture and eddying therebehind is achieved. One such flameholder is in the shape of a cylinder having helical channels cut around its peripheral cylindrical surface, from end to end. Another takes the form of a plurality of angled vanes which may be made of cast material or stamped out of flat plate. The vanes surround a central hub portion. The surfaces of the vanes cause the desired swirling or vortex effect, whereas the abrupt trailing edges thereof act as bluff bodies to achieve the desired bluff body wakes.

Other objects and advantages of the invention will become apparent from review of the following description and drawings.

DETAILED DESCRIPTION OF THE INVENTION

Figure 1:
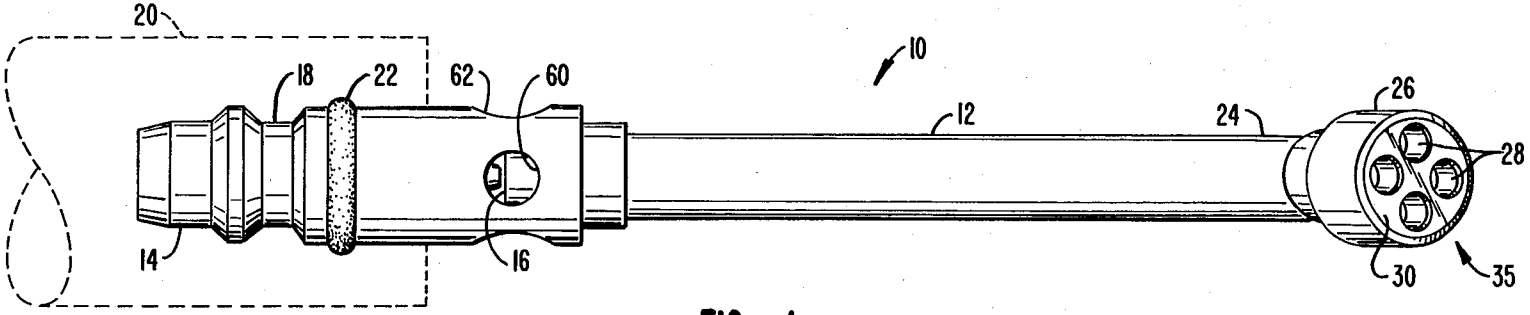
FIG. 1 is a top elevational view of a multiple burner torch tip embodying the instant invention.

As shown in FIG. 1, the multiple burner torch tip shown generally at 10 includes a generally elongated tube or stem 12 which may be of stainless steel material. A generally tubular base 14, which may be of brass material, is press fitted over an inlet end 16 of tube 12. Base 14 has a circumferential groove 18 therearound which mates with a conventional torch handle structure shown in dotted line at 20. An O-ring seal 22, which may be made of rubber or other resilient material, helps to seal the base into the torch handle 20. Fitted over the outlet end 24 of tube 12 is a generally cylindrical head 26 having a plurality of symmetrically arranged burners 28 on the planar face 30 thereof. As shown in this figure, a preferred embodiment includes four identically sized burners, although various numbers of burners can be selected.

Figure 2:
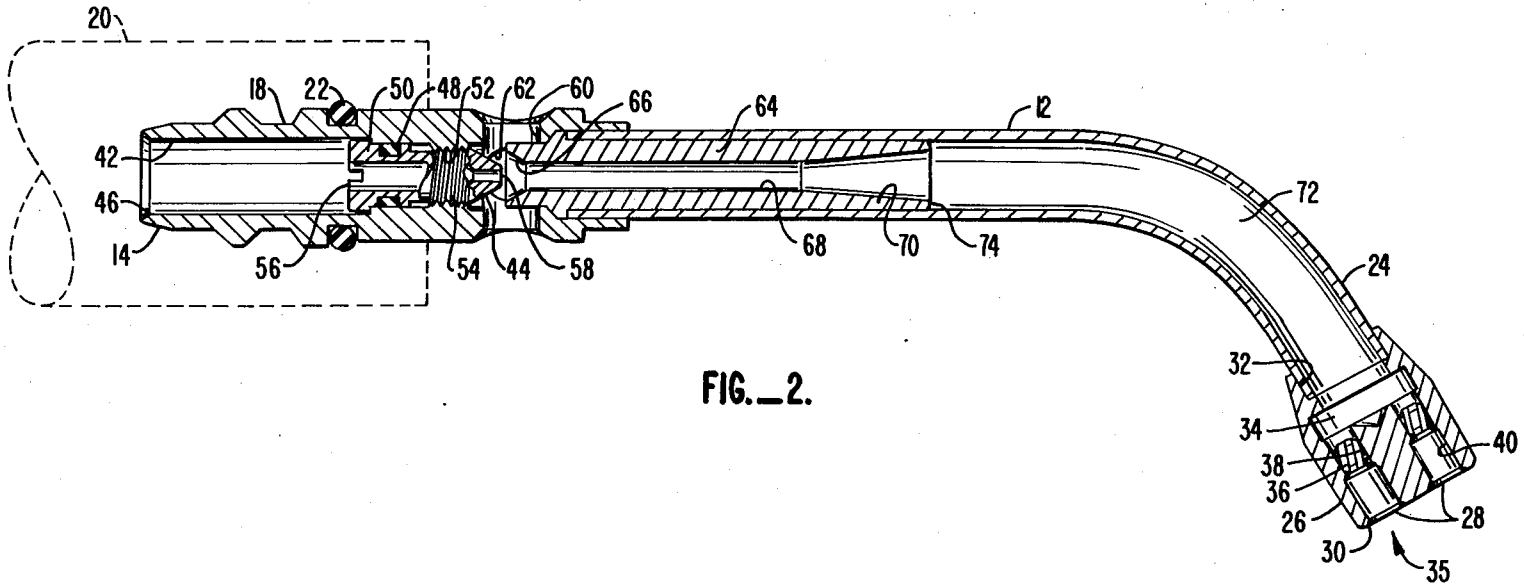
FIG. 2 is a schematic, cross-sectional side elevational view of the multiple burner torch tip.

Turning to FIG. 2, the head 26 which may be conveniently made of stainless steel material, has an internal inlet bore 32 press fitted over upper end 24 of tube 12. The enlarged cylindrical transition chamber 34 is centrally disposed within head 26 and is dimensioned and positioned so as to equally distribute combustible gas to the burners. The plurality of burners 28 each consist of a flameholder 36 fitted within a like number of accommodating bores 38 which forms a plurality of cylindrical combustion chambers 40. As aforementioned, each flameholder and combustion chamber comprises a burner.

Threadedly secured within a stepped axial bore 42 in base 14 is an orifice member 44 which is used to meter an appropriate amount of fuel from a fuel source (not shown) connected to handle 20 by way of inlet 46 in base 14. An O-ring seal 48 located in a groove 50 peripherally around the intermediate body portion of orifice member 44 assures sealing contact with the interior of stepped bore 42. Orifice member 44 is removable by means of mating threads 52 within stepped bore 42 and external threads 54 on orifice member 44. A stepped axial bore 56 centrally disposed within orifice member 44 channels fuel from inlet 46 through bore 42 and thence through a metering orifice 58 in the downstream end of orifice member 44.

A pair of right angle intersecting cross passages 60, 62 intersect at orifice 58. These cross passages permit air from the ambient surrounds to be drawn into a venturi 64 which functions as a jet pump. These cross passages are sized for negligible air pressure loss, and for maximizing the quantity of air that can be pumped. While four holes in two intersecting cross passages have been shown and described, any number of properly sized air holes may be used. Venturi 64 is a generally tubular member fitted within tube 12 and is conveniently of an easily formed metal material such as aluminum. The venturi has a converging inlet section 66, followed by a straight constant diameter intermediate section 68, followed by a diverging diffuser section 70. The diffuser section 70 exits into a mixing chamber 72 which is defined at one end by an outlet 74 of the diffuser section 70 and at the other end by the transition chamber 34 of head 26. As may be seen, tube 12 may be bent to an angle to facilitate a positioning vis-a-vis the workpiece (not shown).

Figure 3A:
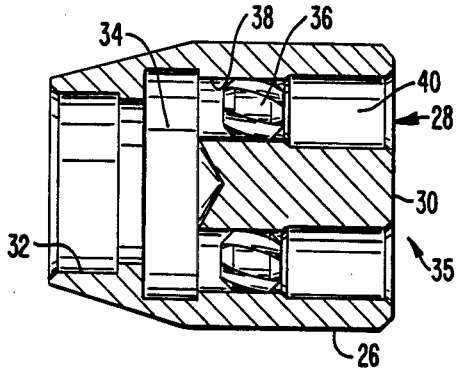
FIG. 3A is a cross sectional view of the same taken along the lines 3A—3A in FIG. 3.
Figure 3:
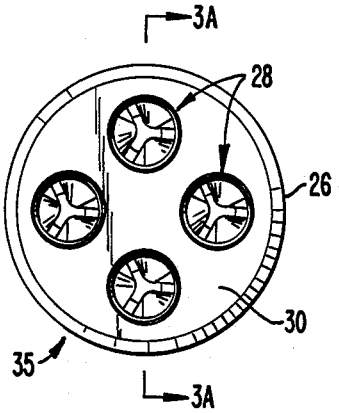
FIG. 3 is an end view of the preferred embodiment of a torch head of the instant invention having four burners.

Turning to FIG. 3, a preferred embodiment includes four burners of equal diameter and equally spaced around the central axis of and on the face 30 of head 26. As shown in the cross sectional view of FIG. 3A, each burner 28 includes a flameholder 36 fitted within bore 38 within head 26. Flameholder 36 is located intermediate the transition chamber 34 and the combustion chamber 40.

Figure 4A:
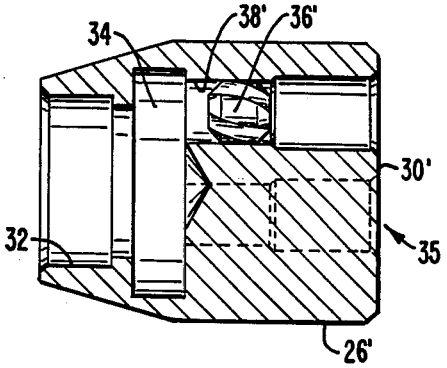
FIG. 4A is a cross sectional view taken along the lines 4A—4A in FIG. 4.
Figure 4:
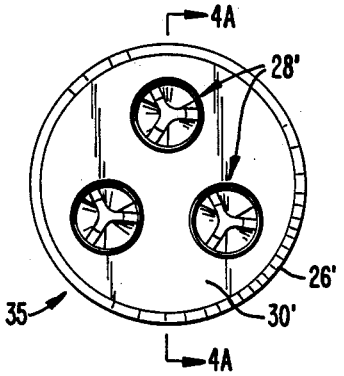
FIG. 4 is a view similar to FIG. 3 of another embodiment having three burners.

As shown in FIG. 4, an alternate embodiment includes three burners 28' equally spaced around the central axis of and on the face 30' of head 26'. In similar fashion to the preferred embodiment, flameholders 36' are fitted within accomodating bores 38'.

Figure 5:
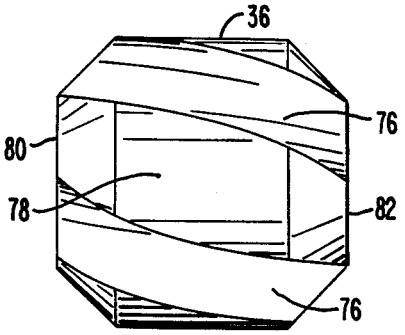
FIG. 5 is an enlarged side elevational view of the flameholder of the instant invention.
Figure 6:
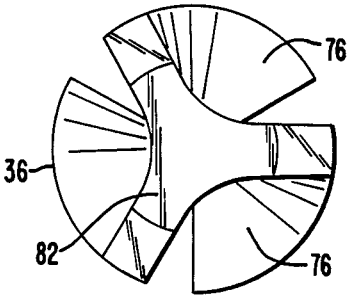
FIG. 6 is a right end elevational view of the flameholder shown in FIG. 5.

The flameholders themselves may, in a preferred embodiment, be constructed as shown in FIGS. 5 and 6. As shown, the flameholders 36 are generally cylindrically shaped members having a plurality of helical grooves 76 cut or formed in the cylindrical side surface 78 thereof. The grooves extend from the flat upstream face 80 to the downstream, or bluff body face 82.

Returning to FIG. 2, the operation of the multiple burner torch tip may be described as follows. The tip 10 is connected to a torch handle shown in dotted line at 20, having a valve (not shown) for admission of a fuel such as propane or the like from a fuel source (not shown) such as a compressed gas cylinder. Fuel enters through inlet 46 and passes through bore 42 within base 14. Fuel is then metered through orifice member 44 and exits through orifice 58 into the vicinity of the intersection of cross passages 60 and 62, the purpose of which is to admit ambient air.

Venturi 64 functions as a jet pump or injector, using fuel momentum to draw air through converging inlet section 66 of venturi 64. The fuel and air mixture then passes through central straight section 68 and expands through diffuser section 70 and thence into mixing chamber 72. The fuel and air are mixed further in mixing chamber 72 and the mixture passes into transition chamber 34 where it is distributed to the plurality of burners 28.

Combustion air is brought into the torch by the injector assembly, which consists of the fuel orifice 44, the venturi 64, and air inlets 60 and 62. Momentum of fuel gas exiting orifice 44 is transferred to combustion air in venturi 64, thereby inducing air to flow through air inlets 60 and 62, through the venturi 64, through the mixing chamber 72, the transition chamber 34, and the burners 36. The dimensions of the fuel orifice, the air inlets, and the venturi are critical, in that the energy for pumping air against the system pressure drop is supplied by fuel momentum, which is very limited. Low burner pressure drop is also necessary in order to succeed in providing the stoichiometric quantity of combustion air, which is approximately 15 pounds of air per pound of fuel gas.

The combustible gas mixture is split as it flows through the flameholders and into their respective combustion chambers, where it is burned. On passing through the flameholder, the combustible mixture has a swirling motion imparted thereto by angled passages within each flameholder such that the mixture is centrifuged against the combustion chamber walls so as to provide cooling thereto. At the same time, a bluff body on the downstream end of each flameholder creates an eddying effect, which enhances flameholding and ensures complete combustion in the combustion chamber. The flames then exit from each chamber.

While the invention has been described in conjunction with a preferred and alternative embodiment thereof, it will be understood that the description is intended to illustrate and not limit the scope of the invention, which is to be defined by the scope of the appended claims.

We claim:

1. A multiple burner torch tip comprising:

a mixing chamber including means for introducing thereto a fuel and an oxidizer so as to produce a combustible gas mixture, said mixing chamber including a downstream mixing chamber outlet, a plurality of combustion chambers, each of said combustion chambers including a combustion chamber inlet and a combustion chamber outlet, each of said combustion chambers located substantially adjacent at least two other combustion chambers so as to enhance mixing of fluid flowing therethrough, a plurality of flameholders, each of said flameholders being positioned between said mixing chamber and respective combustion chamber inlet, each of said flameholders having means thereon for imparting a swirling motion to a combustible gas mixture passing through said mixing chamber and said flameholders and further including means thereon for producing eddying of said mixture so as to enhance flameholding and ensure more complete combustion.

2. The invention of claim 1 wherein said torch tip is a generally elongated, tubular member defining opposite inlet and outlet openings and including, a head fitted over said outlet opening, wherein said plurality of combustion chambers is located in said head and communicating said outlet opening with the exterior of said head.

3. The invention of claim 2 wherein said torch tip further includes a hollow base member fitted over said inlet opening and communicating the interior of said tubular member with the exterior of said base member, said base member being adapted to be connected to a source of fuel whereby fuel may be conducted from the source of fuel through said base member and into said tubular member.

4. The invention of claim 3 further including an orifice means in said base member for regulating the flow of fuel into said tubular member.

5. The invention of claim 4 further including at least one cross passage in said base member adjacent said orifice means, said cross passage communicating the exterior of said base member with said orifice means so as to communicate ambient air with fuel exiting from said orifice means.

6. The invention of claim 5 further including a venturi means intermediate said orifice means and said mixing chamber, said venturi means acting as a jet pump to draw air from the ambient surrounds through said cross passage where it continues with fuel exiting from said orifice means and thence through said venturi means and into said mixing chamber where said fuel and air are mixed to form said combustible mixture.

7. The invention of claim 6 wherein said venturi means comprises a venturi having an upstream converging section, followed by an intermediate straight section, and then followed by a diverging diffuser section.

8. The invention of claim 1 wherein each of said flameholders comprises a body, and wherein said means for producing eddying is a bluff portion on the downstream end of said body.

9. The invention of claim 1 wherein each of said flameholders comprises a body, and wherein said means for producing a swirling motion to said combustible gas mixture is at least one channel on said body oriented at an angle to the direction of gas flow through the torch tip.

10. The invention of claim 1 wherein each of said flameholders comprises a body, and wherein said means for producing eddying is a bluff portion on the downstream end of said body, and said means for producing a swirling motion to said combustible gas mixture is at least one channel on said body oriented at an angle to the direction of gas flow through the torch tip.

11. The invention of claim 1 wherein the number of combustion chambers is three.

12. The invention of claim 1 wherein the number of combustion chambers is four.

13. The invention of claim 1 further including a transition chamber intermediate said mixing chamber outlet and said flameholders for distributing combustible gas to said flameholders.

14. The invention of claim 13 wherein said transition chamber is dimensioned and positioned so as to equally distribute combustible gas to said flameholders.

15. The invention of claim 2 wherein said head defines a generally planar face portion, and wherein said combustion chamber outlets are located in said face portion.

16. The invention of claim 2 wherein said head defines a central axis, and wherein said plurality of combustion chamber outlets are equally spaced from said central axis.

17. The invention of claim 1 wherein said combustion chamber outlets are equally spaced from each other.

18. The invention of claim 1 wherein said combustion chambers are of generally cylindrical shape defining an inner, cylindrical wall and circular outlets.

19. The invention of claim 1 wherein all of said imparting means are configured for producing said swirling motion in a common rotational direction.

20. The invention of claim 15 wherein said combustion chamber outlets are symmetrically located with respect to said central axis.

* * * * *